US008857450B2

(12) United States Patent
Haltmayer et al.

(10) Patent No.: US 8,857,450 B2
(45) Date of Patent: Oct. 14, 2014

(54) DISHWASHER AND BASE TRAY FOR SAID DISHWASHER

(75) Inventors: Werner Haltmayer, Dinkelsbühl (DE); Mathias Herrmann, Nattheim (DE); Stefan Kasbauer, Dillingen (DE); Claus Köther, Niederstotzingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1114 days.

(21) Appl. No.: 12/381,885

(22) Filed: Mar. 17, 2009

(65) Prior Publication Data

US 2009/0266386 A1 Oct. 29, 2009

(30) Foreign Application Priority Data

Apr. 25, 2008 (DE) ..... 10 2008 020 887

(51) Int. Cl.
*A47L 15/42* (2006.01)
*A47L 15/23* (2006.01)
*D06F 39/08* (2006.01)

(52) U.S. Cl.
CPC ..... *A47L 15/4221* (2013.01); *A47L 15/4246* (2013.01); *D06F 39/083* (2013.01)
USPC ..... 134/103.1; 134/56 D

(58) Field of Classification Search
USPC ..... 134/103.1
See application file for complete search history.

(56) References Cited

U.S. PATENT DOCUMENTS

| | | | | |
|---|---|---|---|---|
| 6,705,330 | B1 * | 3/2004 | Favret | 134/56 D |
| 2004/0226586 | A1 | 11/2004 | Ertle et al. | |

FOREIGN PATENT DOCUMENTS

| | | | | |
|---|---|---|---|---|
| DE | 2428045 | A1 | 1/1975 | |
| DE | 3442779 | A1 * | 6/1986 | A47L 15/23 |
| DE | 3922755 | A1 * | 1/1991 | A47L 15/42 |
| DE | 102005043026 | A1 | 3/2007 | |
| EP | 0556787 | A1 * | 2/1993 | A47L 15/42 |
| EP | 0556787 | A1 * | 2/1993 | A47L 15/42 |
| EP | 0795292 | A2 * | 9/1997 | A47L 15/23 |
| JP | 2005-74151 | A * | 3/2005 | A47L 15/42 |
| WO | WO 83/01892 | * | 6/1983 | A47L 15/14 |
| WO | WO91/08414 | * | 6/1991 | F16L 33/22 |
| WO | WO00-35335 | A1 * | 6/2000 | A47L 15/42 |

OTHER PUBLICATIONS

English Machine Translation of JP2005-74151A to Kamisaki et al.*
English machine translation of DE3922755A1.*

* cited by examiner

*Primary Examiner* — Michael Barr
*Assistant Examiner* — Jason Riggleman
(74) *Attorney, Agent, or Firm* — James E. Howard; Andre Pallapies

(57) ABSTRACT

A dishwasher includes a washing compartment having a boundary wall with a base, spray devices inside the washing compartment, and a hydraulic circuit with a distributor which subdivides a washing liquor flow into two partial flows which are each routed to the spray devices, wherein the distributor is integrated in the base.

20 Claims, 6 Drawing Sheets

DISHWASHER AND BASE TRAY FOR SAID DISHWASHER

BACKGROUND OF THE INVENTION

The invention relates to a dishwasher as well as to a base tray for a dishwasher.

In an hydraulic circuit of a dishwasher washing liquor is subdivided downstream of a circulating pump into a plurality of partial volumetric flows which are routed to different spray levels inside the washing compartment.

In a generic dishwasher a distributor is therefore provided in the hydraulic circuit in order to split the washing liquor flow into the two partial flows and forward the latter to different spray levels inside the washing compartment. For that purpose a complicated piping system is required inside the dishwasher, wherein the liquor pipes are led into the washing compartment via a plurality of sealing points as well as by means of a plurality of components.

SUMMARY OF THE INVENTION

An object of the invention is to provide a dishwasher having a simplified liquor piping system.

The invention proceeds on the basis of a dishwasher having a washing compartment and a hydraulic circuit in which a distributor is provided which splits a washing liquor flow into at least two partial flows, each of which is routed to spray devices arranged inside the washing compartment.

The distributor is formed from a uniform material and/or as a single piece and is integrated in a boundary wall of the washing compartment, in particular in its base. In contrast to the prior art, the distributor is therefore not provided as a separate component on the outside of the compartment, but is integrated directly into the boundary wall of the washing compartment.

The distributor is therefore integrally molded directly in the boundary wall. The number of sealing points in the piping system can be reduced accordingly: Thus, in a distributor connected separately upstream of the washing compartment—in contrast to the invention—sealing points have to be provided both at its infeed and at its outfeeds. In addition, a further sealing point is provided at the feedthrough opening on the washing compartment side.

With the distributor according to the invention, the sealing points at its infeeds and outfeeds advantageously coincide with the sealing points at the feedthrough opening on the washing compartment side. Overall, therefore, the number of components in the dishwasher's piping system is reduced along with the number of sealing points which are technically complicated to implement in assembly terms.

The boundary wall together with the distributor can preferably be a plastic part which in manufacturing terms is particularly easy to produce using the plastic injection molding method. For cost reasons, in particular the base of the washing compartment, functioning as the boundary wall, can be produced as a plastic part in which the distributor is integrated.

To achieve a simple geometry of the distributor integrated in the boundary wall, on its upstream side the distributor can have an inlet chamber which preferably is fluidically connected to at least two mutually separate outlet chambers. The washing liquor flows into the inlet chamber and is accordingly subdivided into the two outlet chambers, from where the two partial flows are routed to the spray devices. In this case the inlet chamber can protrude downward on the outside directly on the boundary wall, while the two outlet chambers project into the interior of the washing compartment on the opposite side of the boundary wall.

The inlet chamber and the two outlet chambers are preferably separated from one another by way of a distributor wall. Openings can be provided in the distributor wall to allow the two partial flows to flow into the respective outlet chambers. According to the invention, the feedthrough openings known from the prior art for routing liquid pipes through the boundary wall thus functionally coincide with the two distributor openings in the distributor wall.

In order to connect a liquid pipe to the distributor in a liquid-tight as well as simple manner, the inlet chamber of the distributor can be surrounded by an inlet port integrally molded on the boundary wall. At least one assembly element, a screw boss, for instance, can be integrally molded on the outer circumference of the inlet port integrally molded on the boundary wall. A connecting piece of a liquid pipe coming from, say, the circulating pump can in turn be mounted onto the screw boss. For that reason the connecting piece is preferably installed, not directly in the materially weaker boundary wall, but in the assembly element integrated therein whose material strength is adapted according to the requirements.

In order to ensure reliable operation of the dishwasher, the sealing zone between the connecting piece and the inlet port must be provided as liquid-tight. For that purpose the connecting piece can be inserted onto the inlet port in the area of the sealing zone.

In order to produce a sealing contact with the inlet port, the connecting piece can be embodied on the inside with a soft material, in particular a rubber material. On the outside, in contrast, the connecting piece can be enclosed in the area of the sealing zone by an inherently stable, stiffer annular collar. The connecting piece embodied in this way can additionally be fixed to the inlet port by means of a clamping element.

With regard to the limited installation space conditions and in order to reduce a dead volume inside liquid pipes, a short, direct connection between the distributor integrally molded on the floor of the washing compartment and an upstream circulating pump is advantageous.

Against this background the aforementioned connecting piece can be inserted immediately between the integrally molded distributor and a pressure joint of the circulating pump, as a result of which an overall improvement in energy values, with regard, say, to water consumption or energy consumption, can be achieved.

In this case the flow heater can likewise not be provided as a separate element in the dishwasher's piping system, but can be integrated in the circulating pump, thereby enabling economies to be made in respect of further sealing points and/or components.

In addition, a tube element of a spray arm of a bottom spray device can be rotatably mounted on the distributor, and moreover in particular in one of its two outlet chambers. The rotary mounting of the spray arm on the floor of the washing compartment is known in principle. In this case the tube element is arranged roughly concentrically with respect to the hollow cylindrical outlet chamber and rotatably guided therein.

In order to reduce the number of components further, a hub section into which the vertically aligned tube element is inserted can be integrally molded on the distributor wall downstream of a distributor opening. The tube element of the bottom spray arm is implemented in a known manner as a Venturi tube and dimensioned in accordance with the volumetric flow conditions in the dishwasher's hydraulic circuit.

In order to limit a lift movement of the tube element, the distributor can additionally have an integrally molded height stop.

BRIEF DESCRIPTION OF THE DRAWINGS

An exemplary embodiment of the invention is explained below with reference to the attached figures, in which.

DETAILED DESCRIPTION OF EXEMPLARY EMBODIMENTS OF THE PRESENT INVENTION

Figure 1:
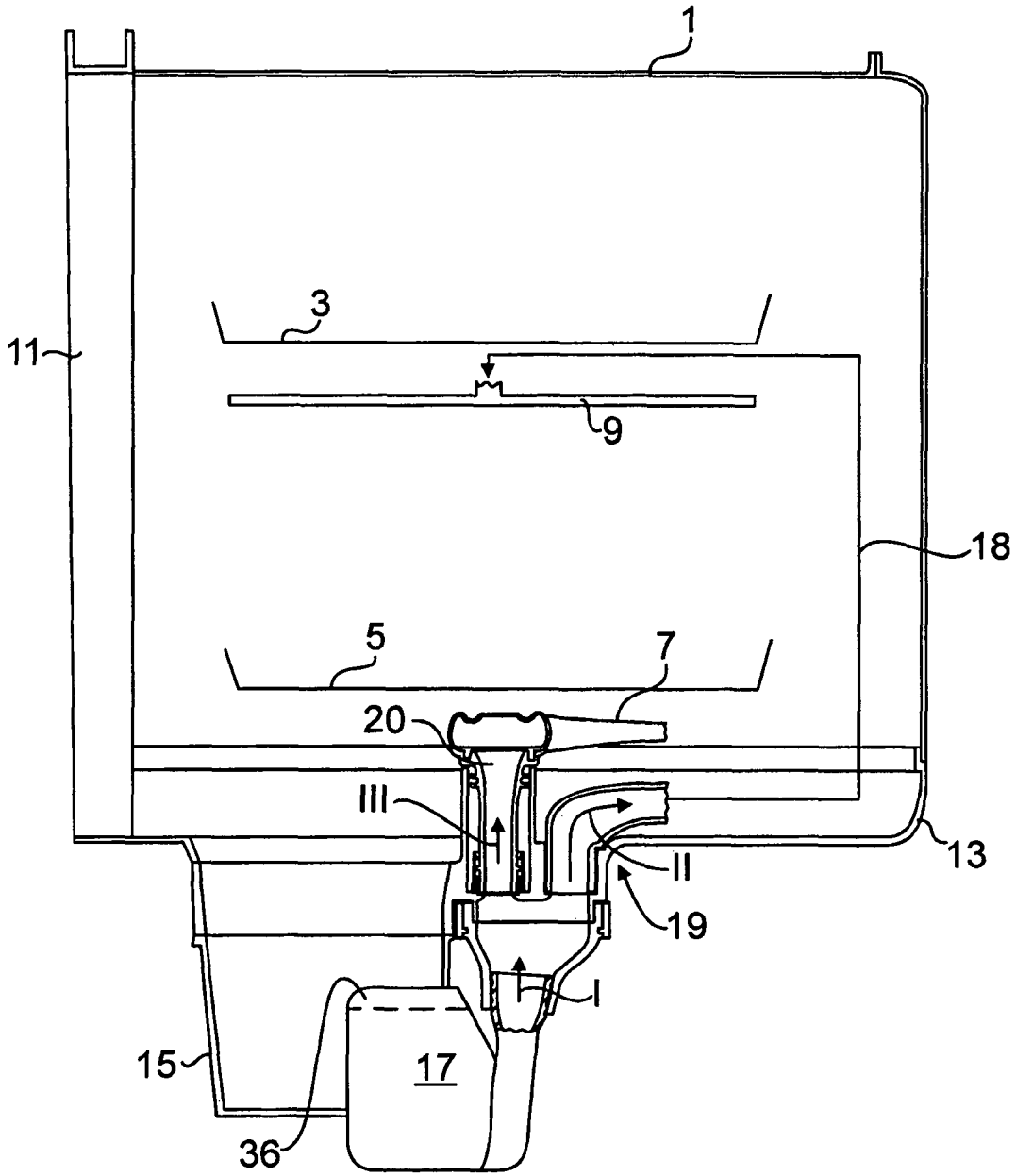
FIG. 1 shows a dishwasher in a roughly schematic sectional side view.

FIG. 1 shows a roughly schematic view of a dishwasher having a washing compartment 1 in which items to be washed (not shown) can be arranged in dishwasher baskets 3, 5. Arranged by way of example as spray devices in the washing compartment 1 shown are two spray arms 7, 9 provided at different spray levels, by means of which spray arms the items to be cleaned are sprayed with washing liquor. The outer housing and the appliance door of the dishwasher are omitted in FIG. 1 for reasons of clarity.

In the exemplary embodiment shown in FIG. 1, the washing compartment 1 together with its top, side and rear walls is manufactured from stainless steel sheet. In contrast, a frame 11 surrounding the front loading opening of the washing compartment 1 and the compartment floor 13 are made from plastic material. In this case the compartment floor 13 is implemented with elevated side walls on the top edges of which sits the rest of the washing compartment 1.

A pump well 15 is provided in a known manner underneath the washing compartment floor 13 along with an associated circulating pump 17 which conducts washing liquor via the indicated liquid pipes 20, 19 to the spray arms 7, 9 in the hydraulic circuit of the dishwasher. The pump well 15 is also connected in the conventional manner via adapters (not shown) to a fresh water infeed pipe and to a drain pipe in which a lye pump (also not shown) is connected for the purpose of pumping out the soiled washing liquor.

A water diverter or a distributor 19 is positioned in a known manner downstream of the circulating pump 17. During a washing cycle of the dishwasher the distributor 19 splits a washing liquor flow I displaced by the circulating pump 17 into two partial flows II, III which are routed to the top and bottom spray arms 7, 9.

Figure 3:
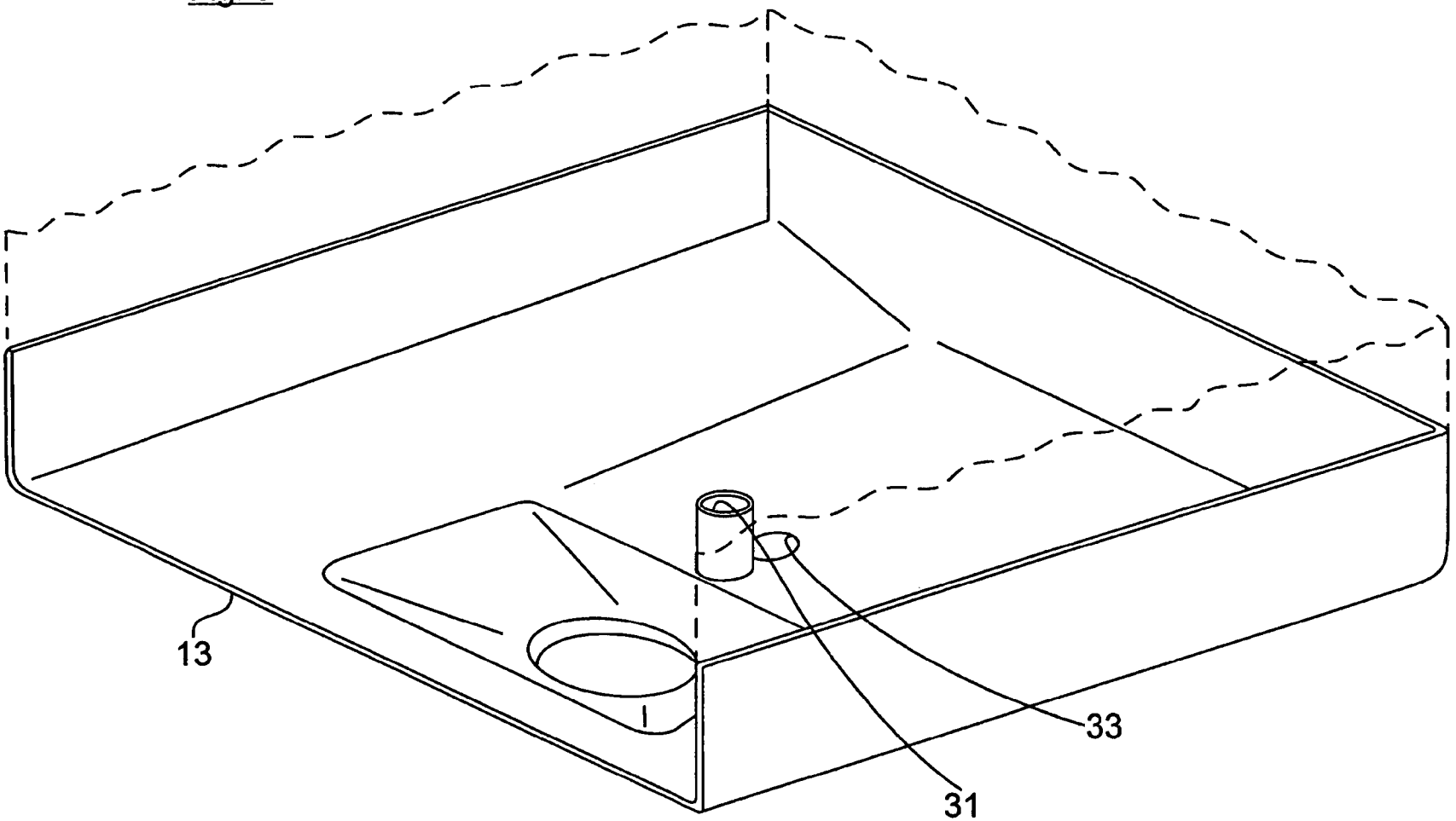
FIG. 3 shows the washing compartment floor on its own in a perspective view.

According to the invention the distributor 19 is formed from a uniform material and as a single piece and is integrated in the plastic base 13 of the washing compartment 1. The base 13 shown on its own in FIG. 3 is in this case embodied together with the distributor 19 integrated therein using the plastic injection molding method.

As can be seen from FIG. 2, the pump well 15 has, in a known manner, an adapter nozzle 14 for the circulating pump 17 which is connected with its pressure joint 16 via a below-described connecting piece 35 directly to the distributor 19 integrally molded on the floor 13.

Figure 4:
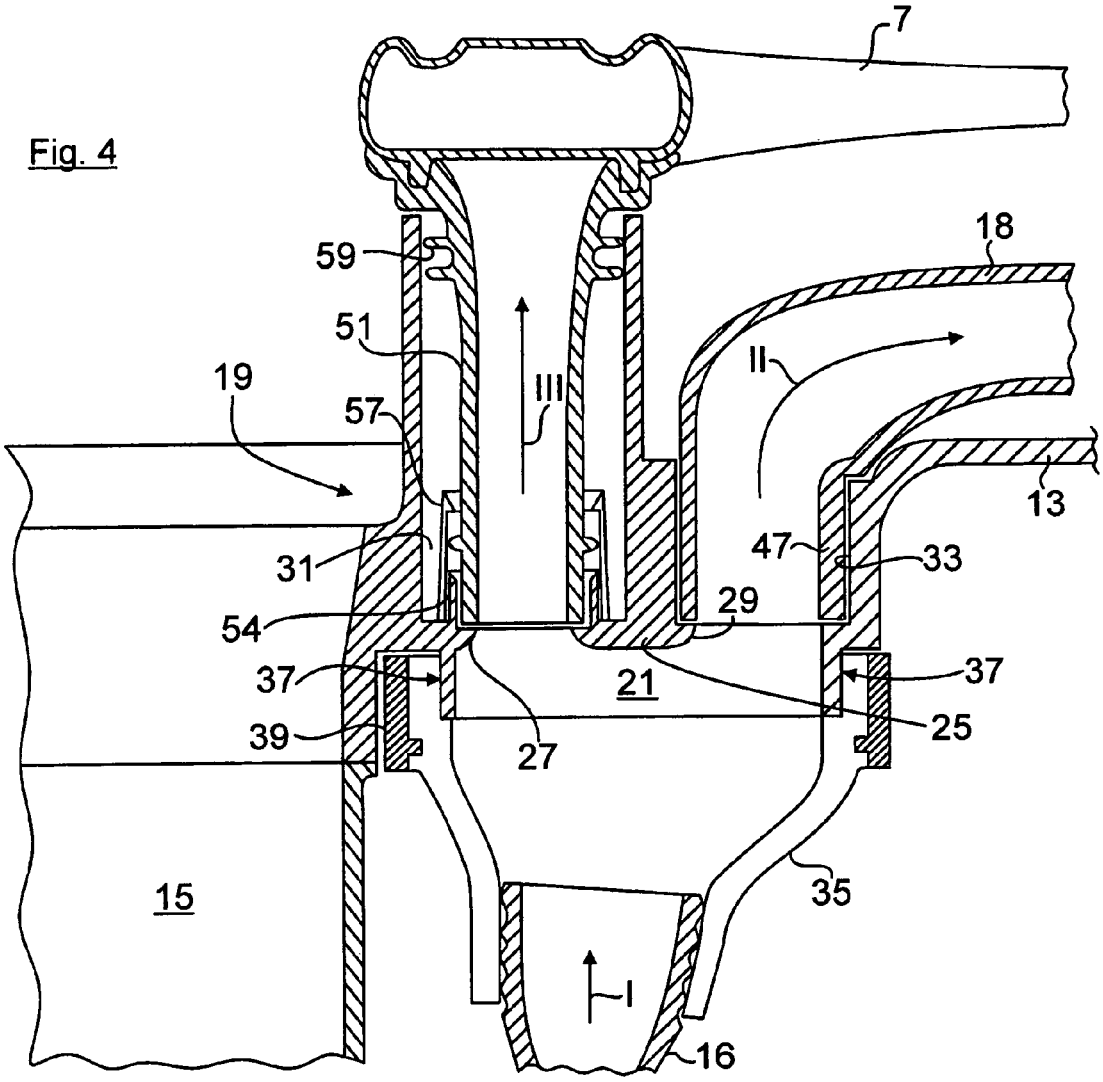
FIG. 4 shows the washing compartment floor with integrated distributor in an enlarged sectional view.
Figure 5:
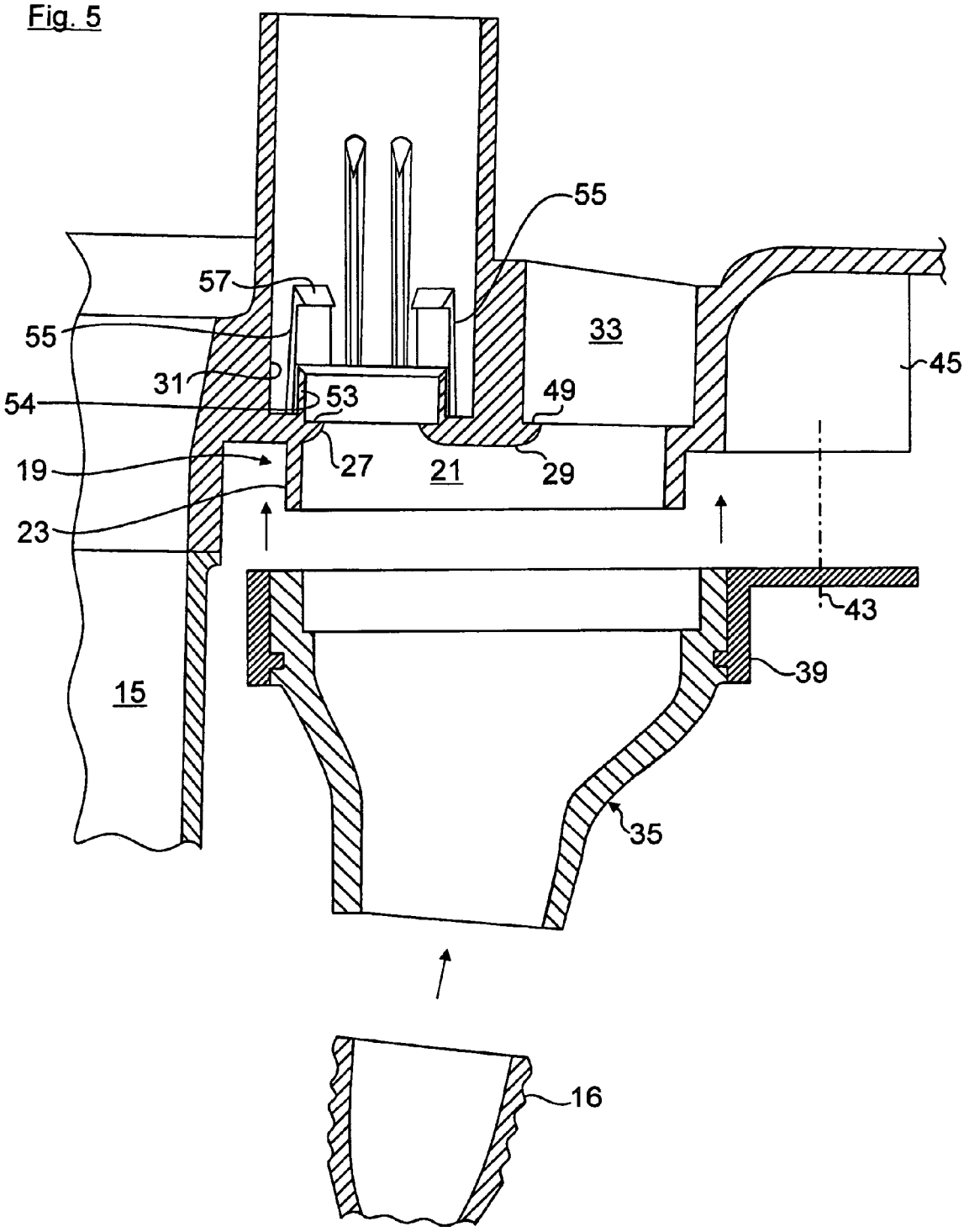
FIG. 5 shows an exploded view corresponding to FIG. 4.
Figure 6:
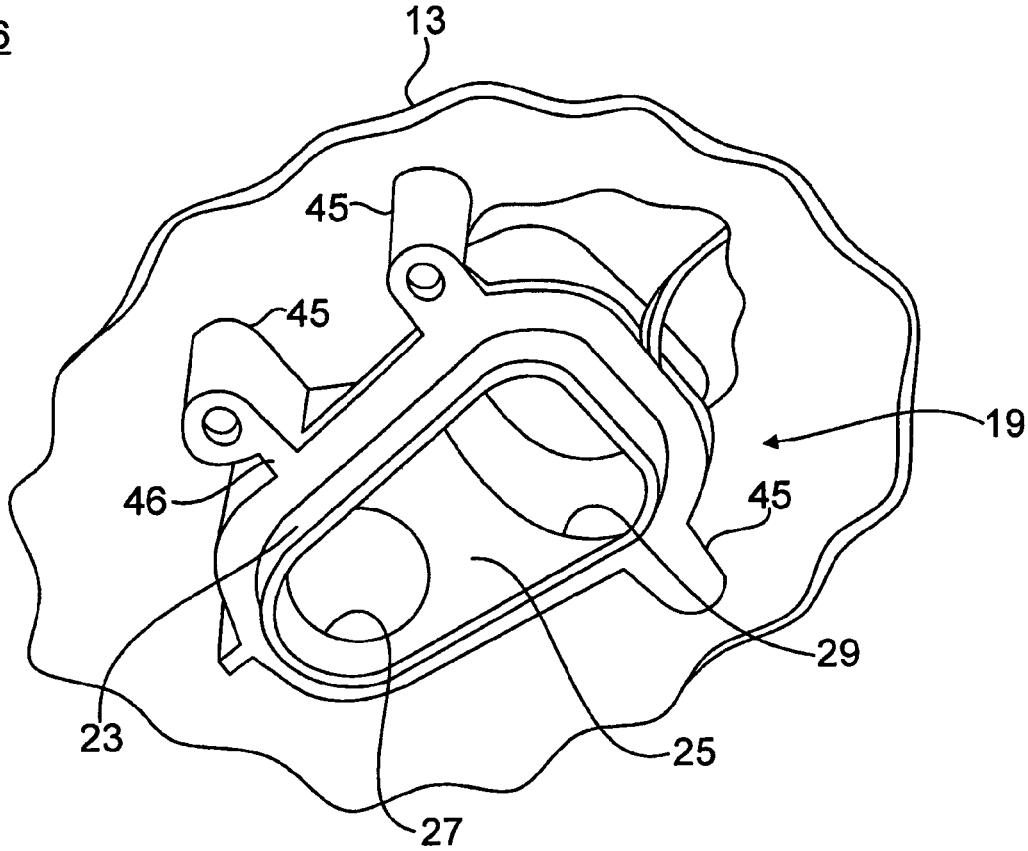
FIG. 6 shows the distributor integrated in the washing compartment floor on its own in an enlarged perspective view.

Shown in an enlarged partial section in FIG. 4 is the center area of the compartment floor 13 in which the distributor 19 is integrated. Thus, on its upstream side, i.e. the underside of the washing compartment floor 13, the distributor 19 has an inlet chamber 21 which is surrounded by an inlet port 23. According to FIG. 6, the inlet port 23 is embodied not as rotationally symmetrical, but as elongate. The inlet port 23 also delimits a distributor wall 25 in which two distributor openings 27, 29 are provided. The two distributor openings 27, 29 fluidically connect the inlet chamber 21 to two mutually separate outlet chambers 31, 33, as shown in FIG. 5.

As already mentioned above, the pressure joint 16 of the circulating pump 17 is directly connected to the inlet port 23 of the distributor 19 via the connecting piece 35. The connecting piece 35 is manufactured in a tubular shape from soft rubber material and pushed onto the inlet port 23 on the outside. A sealing zone 37 is formed between the inlet port 23 and the connecting piece 35. In this area the soft rubber material of the connecting piece 35 is reinforced by means of an outer annular collar 39 which is formed from a stiff plastic material which is inherently stable by comparison with the rubber material. The soft rubber material is placed in the sealing zone 37 between the inlet port 23 and the annular collar 39 under a predefined compressive stress. In addition the annular collar 39 can be enclosed by a clamping element (not shown).

At the end facing away from the distributor 19 the connecting piece 35 is pushed onto the pressure joint 16 of the circulating pump 17, on which pressure joint 16 the connecting piece 35 can likewise be secured by means of a clamping element (not shown).

The separate flow heater typically connected between the circulating pump 17 and the distributor 19 for the purpose of heating the washing liquor has been omitted in this case. Instead, according to FIG. 1, the flow heater 36 is integrated into the circulating pump 17. This enables additional sealing points that are necessary in the case of a flow heater provided as a separate component to be avoided.

Figure 2:
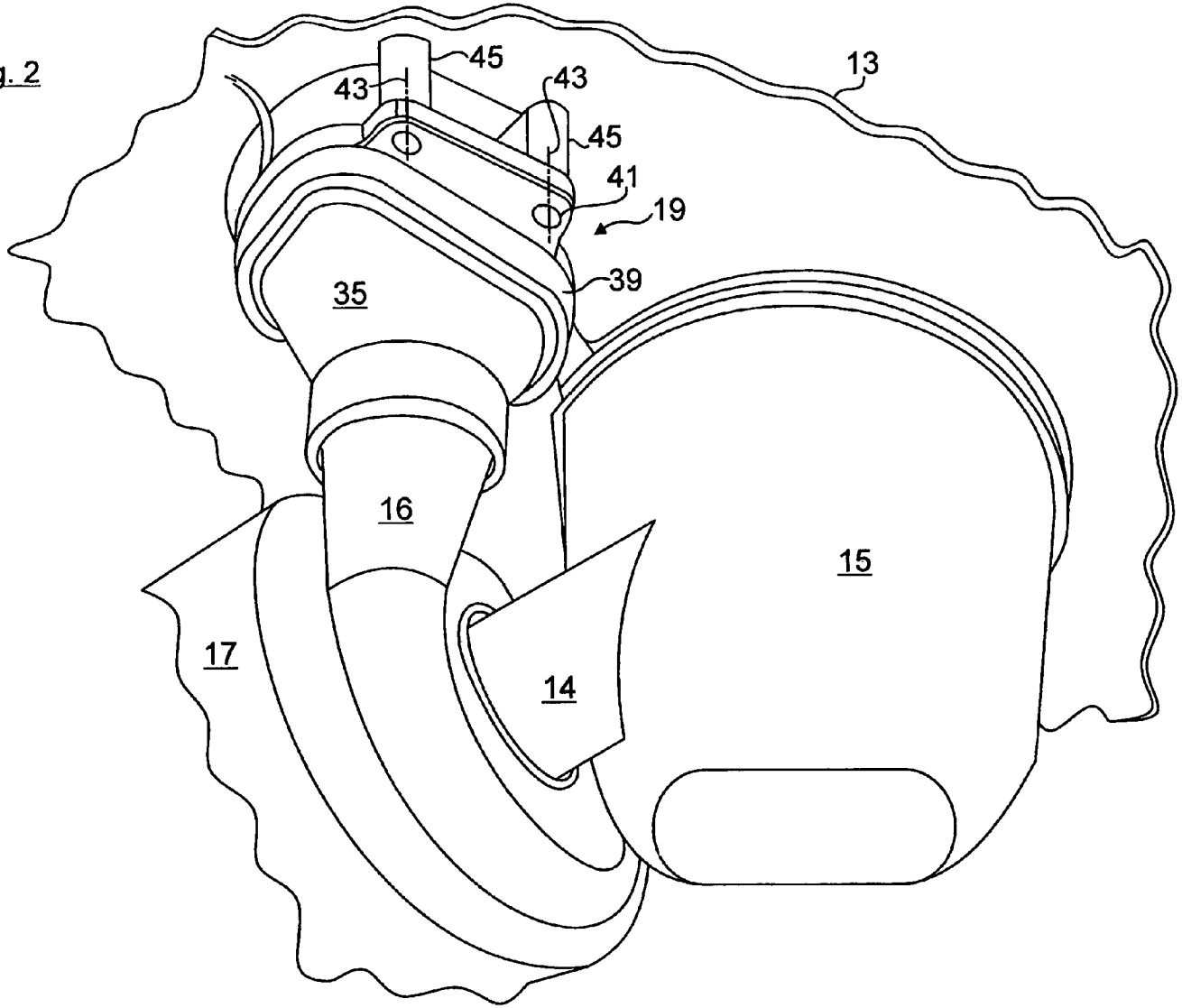
FIG. 2 shows a partial view from below onto the washing compartment floor in a perspective representation.

As can be seen from FIG. 2 and FIG. 5, the annular collar 39 of the connecting piece 35 has a mounting flange 41 projecting downward on the outside, by means of which the connecting piece 35 can be bolted to the compartment floor 13 via indicated screw connections 43. For that purpose screw bosses 45 are integrally molded on the outside of the compartment floor 13 as assembly elements. According to FIG. 6 said screw bosses 45 are directly connected to the distributor 19 via connecting bridges 46, as a result of which the overall rigidity of the distributor 19 can be increased.

Referring to the exploded view shown in FIG. 5, the piping connection between the circulating pump 17 and the distributor 19 will be described. According thereto, the connecting piece 35 together with the exterior annular collar 39 is pushed onto the inlet port 23 of the distributor 19 and the latter bolted by means of the floor-side screw bosses 45. In this arrangement the annular collar 39 is connected as a single piece to the rubber material of the connecting piece 35. In contrast, the end of the connecting piece 35 facing away from the distributor 19 is placed onto the pressure joint 16 of the circulating pump 17.

As is also evident from FIG. 5, the second outlet chamber 33 of the distributor 19 is shaped roughly matched in outline to an adapter piece 47 (shown in FIG. 4) of the liquid pipe 18 leading to the top spray arm 9. The adapter piece 47 of the liquid pipe 18 is in this case pushed as far as an annular shoulder 49 delimiting the distributor opening 29 and sits on said shoulder. In the same way a Venturi tube element 51 sits in the first outlet chamber 31 on an annular shoulder 53 which delimits the distributor opening 27. In this arrangement the Venturi tube element 51 is rotatably mounted in the hub section 54 which projects in a hollow cylindrical manner into the first outlet chamber 31. Integrally molded radially on the distributor wall 25 outside the hub section 54 are resiliently flexible detent tongues 55 drawn vertically upward. At their upper free ends the detent tongues 55 each have detent projections 57 which, acting as height stops, delimit a lift movement of the Venturi tube element 51 of the bottom spray arm 7. In addition the Venturi tube element 51 has on its outside in a known manner circumferential ribs 59 which ensure a concentric locating of the Venturi tube element 51 inside the hollow cylindrical outlet chamber 31.

The invention claimed is:

1. A dishwasher comprising:

a washing compartment delimited at least in part by a boundary wall that separates the washing compartment from an area outside of the washing compartment;

spray devices inside the washing compartment; and a hydraulic circuit with a distributor which subdivides a washing liquor flow having a flow direction into two partial flows which are each routed to the spray devices, wherein the distributor is integrally molded with the boundary wall such that the distributor and the boundary wall are one unitary, integrally molded unit, the distributor has only one inlet chamber, the inlet chamber being on a side of the distributor that is upstream relative to the flow direction and on a first side of the boundary wall, and two outlet chambers that are on a side of the distributor that is downstream of the inlet chamber relative to the flow direction and on a side of the boundary wall that is opposite to the first side, the two partial flows flowing in the flow direction as they flow through the two outlet chambers, the distributor having a distributor wall which is perpendicular to the flow direction and is located where the inlet chamber meets the two outlet chambers, the inlet chamber is fluidly connected to the two outlet chambers via which the partial flows are routed to the spray devices, and the inlet chamber is formed by an inlet port integrally molded on the boundary wall.

2. The dishwasher of claim 1, wherein the boundary wall and the distributor form an injection molded plastic part.

3. The dishwasher of claim 1, wherein the inlet chamber projects from the boundary wall on an outside of the washing compartment.

4. The dishwasher of claim 1, wherein a screw boss is integrally molded on an outer circumference of the inlet port on which a connecting piece of a liquid pipe can be mounted.

5. The dishwasher of claim 4, wherein the connecting piece is inserted onto the outside of the inlet port in a liquid-tight manner.

6. The dishwasher of claim 5, wherein in an area of a sealing zone with the inlet port the connecting piece comprises a rubber material in sealing contact with the inlet port.

7. The dishwasher of claim 6, wherein in the area of the sealing zone the connecting piece is enclosed by an annular collar formed from a plastic material.

8. The dishwasher of claim 4, wherein the connecting piece is connected between the distributor and a pressure joint of a circulating pump.

9. The dishwasher of claim 8, wherein a heating element which heats the washing liquor is integrated in the circulating pump.

10. The dishwasher of claim 1, further comprising a tube element of a spray arm of a bottom spray device rotatably mounted in one of two outlet chambers of the distributor.

11. The dishwasher of claim 10, further comprising a hub section integrally molded on a wall of the distributor and receiving the tube element.

12. The dishwasher of claim 10, further comprising a height stop integrally molded on the distributor that delimits a lift movement of the tube element.

13. The dishwasher of claim 1, wherein the boundary wall is a base tray of the washing compartment.

14. The dishwasher of claim 1, wherein the two outlet chambers project from the boundary wall into an interior of the washing compartment.

15. The dishwasher of claim 14, wherein the inlet chamber projects from the boundary wall on an outside of the washing compartment.

16. The dishwasher of claim 1, wherein the inlet port is a peripheral wall surrounding the inlet chamber and extends perpendicularly from the boundary wall.

17. The dishwasher of claim 16, wherein a portion of the boundary wall forms a portion of one of the two outlet chambers.

18. A base tray for a washing compartment of a dishwasher, the tray comprising:

a distributor integrally molded with the base tray such that the distributor and the base tray are one unitary, integrally molded unit, the distributor subdividing a washing liquor flow into two partial flows which are each routed to spray devices, wherein the distributor has only one inlet chamber, the inlet chamber being on a side of the distributor that is upstream relative to a flow direction of the washing liquor flow and on a first side of a boundary wall of the base tray, and two outlet chambers that are on a side of the distributor that is downstream of the inlet chamber relative to the flow direction and on a side of the boundary wall of the base tray that is opposite to the first side, the two partial flows flowing in the flow direction as they flow through the two outlet chambers, the distributor having a distributor wall which is perpendicular to the flow direction and is located where the inlet chamber meets the two outlet chambers, the inlet chamber is fluidly connected to the two outlet chambers via which the partial flows are routed to the spray devices, and the inlet chamber is formed by an inlet port integrally molded on the base tray.

19. The base tray of claim 18, wherein the inlet port is a peripheral wall surrounding the inlet chamber and extends perpendicularly from an exterior surface of the base tray.

20. The base tray of claim 19, wherein a wall section of the base tray separates one of the two outlet chambers on one side of the wall section from an exterior of the base tray on an opposite side of the wall section.

* * * * *